US008945366B2

(12) United States Patent
Ostrovsky

(10) Patent No.: US 8,945,366 B2
(45) **Date of Patent: *Feb. 3, 2015**

(54) METHOD OF ANODIZING METALLIC SURFACES AND COMPOSITIONS THEREFORE

(75) Inventor: Ilya Ostrovsky, Kibbutz Alonim (IL)

(73) Assignees: Chemetall GmbH, Frankfurt am Main (DE); Alonim Holding Agricultural Cooperative Society Ltd., Kibbutz Alonim (IL)

( * ) Notice: Subject to any disclaimer, the term of this patent is extended or adjusted under 35 U.S.C. 154(b) by 0 days.

This patent is subject to a terminal disclaimer.

(21) Appl. No.: 12/661,988

(22) Filed: Mar. 26, 2010

(65) Prior Publication Data

US 2010/0230289 A1 Sep. 16, 2010

Related U.S. Application Data

(63) Continuation of application No. 10/781,973, filed on Feb. 18, 2004, now Pat. No. 7,780,838.

(51) Int. Cl.

| | |
|---|---|
| ***C25D 11/06*** | (2006.01) |
| ***C25D 11/30*** | (2006.01) |
| ***C25D 11/02*** | (2006.01) |

(52) U.S. Cl.

CPC ..... *C25D 11/024* (2013.01); *C25D 11/06* (2013.01); *C25D 11/30* (2013.01); *C25D 11/026* (2013.01)

USPC ..... 205/321; 205/322; 205/326

(58) Field of Classification Search

USPC ..... 205/321, 326

See application file for complete search history.

(56) References Cited

U.S. PATENT DOCUMENTS

| | | | | |
|---|---|---|---|---|
| 3,914,160 | A * | 10/1975 | Fueki et al. | 205/254 |
| 4,152,221 | A * | 5/1979 | Schaedel | 205/108 |
| 4,416,742 | A * | 11/1983 | Kinase et al. | 205/264 |
| 4,861,440 | A * | 8/1989 | Covino | 205/112 |
| 5,720,866 | A * | 2/1998 | Erokhine et al. | 205/83 |
| 6,200,943 | B1 * | 3/2001 | Romack et al. | 510/285 |
| 6,690,573 | B2 * | 2/2004 | Honda et al. | 361/509 |
| 6,875,334 | B2 * | 4/2005 | Ostrovsky | 205/316 |
| 6,916,414 | B2 * | 7/2005 | Dolan | 205/316 |
| 7,780,838 | B2 * | 8/2010 | Ostrovsky | 205/200 |
| 2001/0044405 | A1 * | 11/2001 | Perella et al. | 510/433 |
| 2003/0079994 | A1 * | 5/2003 | Dolan | 205/102 |

OTHER PUBLICATIONS

F. A. Lowenheim, Electroplating, McGraw-Hill Book Company, New York, 1978, pp. 135, 520-521.*

F. A. Lowenheim, Electroplating, McGraw-Hill Book Company, New York, 1978, pp. v.-vi., 135, 520-521.*

* cited by examiner

*Primary Examiner* — James Lin

*Assistant Examiner* — William Leader

(74) *Attorney, Agent, or Firm* — James R. Crawford; Fulbright & Jaworski LLP

(57) ABSTRACT

A method of treating metallic workpieces with an anodizing solution, compositions of the anodizing solution and the coatings prepared with this anodizing solution for anodizing metallic surfaces, especially surfaces of magnesium, magnesium alloys, aluminum and aluminum alloys, are disclosed. The compositions are basic aqueous solutions comprising a water-soluble inorganic hydroxide, phosphorus and oxygen containing anions, at least one surfactant and an alkaline buffer based on at least one alkaline hydrolyzed silane, on at least one alcohol showing at least one alkaline radical group or on a mixture of them.

9 Claims, 1 Drawing Sheet

METHOD OF ANODIZING METALLIC SURFACES AND COMPOSITIONS THEREFORE

This application is a continuation application of U.S. Ser. No. 10/781,973 filed Feb. 18, 2004 now U.S. Pat. No. 7,780,838, herein incorporated by reference in its entirety.

FIELD OF THE INVENTION

The present invention is directed to a composition of an anodizing solution which is useful for the treatment of surfaces of anodizable metallic materials like magnesium, magnesium alloys, aluminum and aluminum alloys, to a method of treating the surface of a metallic workpiece with an anodizing solution as well as to the coatings generated.

BACKGROUND OF THE INVENTION

The light weight and strength of light metals and their alloys and especially of magnesium and magnesium alloys makes products fashioned therefore highly desirable for use in manufacturing critical components of, for example, aircrafts, terrestrial vehicles and electronic devices. One of the most significant disadvantages of magnesium and magnesium alloys is corrosion. Exposure to corrosive or oxidizing conditions causes magnesium and magnesium alloy surfaces to corrode rather quickly, corrosion that is both unaesthetic and reduces strength.

There are many methods for improving the corrosion resistance of a magnesium and magnesium alloy workpiece by modifying the surface of the workpiece. It is generally accepted that the best corrosion resistance for magnesium and magnesium alloy surfaces is achieved by anodizing. In anodizing, a metallic workpiece is used as an anode of an electrical circuit. The circuit includes an electrolyte bath in which the workpiece is contacted, mostly by immersing, seldom by spraying. Depending on the properties of the current used, the bath temperature and the composition of the electrolyte bath, the surface of the workpiece is modified in various ways.

Various aqueous solutions and various additives had been found in, for example: U.S. Pat. No. 4,023,986 (trihalogenated compounds and a group 1b, 2, 3a, 4b, 5b, 6b and 8 metal and an arylamine); U.S. Pat. No. 4,184,926 (alkali metal silicate and alkali metal hydroxide solution); U.S. Pat. No. 4,551,211 (aluminate and alkali hydroxide and boron/sulfate/phenol/iodine solution); U.S. Pat. No. 4,620,904 (basic silicate and hydroxide and fluoride solution); U.S. Pat. No. 4,978,432 (alkaline pH with borate/sulfonate, phosphate and fluoride/chloride solution); U.S. Pat. No. 5,264,113 (alkaline pH with fluoride containing aqueous solution followed by alkaline solution with hydroxide, fluoride and silicate); U.S. Pat. No. 5,470,664 (neutral NH4F solution followed by alkaline solution containing hydroxide, fluoride/fluorosilicate and silicate); U.S. Pat. No. 5,792,335 (ammonia and phosphate containing aqueous solution with an optional content of ammonium salts and of peroxides); and U.S. Pat. No. 6,280,598 (aqueous solution with various amines/ammonia and phosphate/fluoride with optional sealing agents).

Although anodizing is effective in increasing the corrosion resistance and the hardness of the surface, the anodizing coating does not up to now fulfill all requirements expected.

The metallic surfaces coated with an anodizing coating usually become very rough. The anodizing coatings show typically many pores caused by sparking during the anodizing procedure, especially in combination with break-downs or bigger flames. These pores trap humidity and other corrosion-inducing agents. Upon exposure to extreme conditions, humidity is trapped in the pores leading to corrosion. The use of ammonia or amine in the solutions as taught in U.S. Pat. No. 5,792,335 and in U.S. Pat. No. 6,280,598 apparently prevents sparking, leading to smaller pores. However, the coatings built in so called "non-spark processes" only have a low thickness, which is often in the range from about 3 to about 5 μm and have often a low wear resistance. The use of a high concentration of ammonia in an anodizing solution makes it almost impossible to apply this solution in industry without expensive equipment as there is a strong poisonous smell so that there has to be an equipment of closed chambers with exhaustion. In U.S. Pat. No. 6,280,598, it is explicitly stated that the use of alkali hydroxide salts is not preferred in an anodizing solution. There, the occurrence of sparking during the anodizing is discouraged because of several undesirable phenomena mentioned in columns 1 and 2.

It would be highly advantageous to have a method for treating metallic surfaces which are anodizable like surfaces of magnesium, magnesium alloys, aluminum, aluminum alloys, titanium, titanium alloys, beryllium or of beryllium alloys so as to have a high corrosion and wear resistance. It would be favorable if then anodizing coatings would be generated with a low roughness, with a reduced number of big pores or with smaller pores. Further on, it is preferable that such a treatment is environmentally friendly and does not include—as far as possible—fluorides, ammonia, heavy metals and other hazardous components.

SUMMARY OF THE INVENTION

The present invention concerns a method and a composition for anodizing metallic surfaces that may be anodized as well as the anodizing coating generated, especially on surfaces of magnesium, magnesium alloys, aluminum, aluminum alloys, titanium, titanium alloys, beryllium, beryllium alloys and mixtures of these types of surfaces. Hereinafter, the term "magnesium surface" will be understood to mean surfaces of magnesium metal or of magnesium-containing alloys. The composition of the anodizing solution is an alkaline aqueous solution comprising phosphorus and oxygen containing anions like orthophosphate anions, at least one surfactant, at least one water-soluble inorganic hydroxide and at least one constituent selected from the group consisting of alcohols comprising at least one alkaline radical group, of at least one hydrolyzed alkaline silane and a mixture of them.

The method of treating the surface of a metallic workpiece according to the invention comprises the steps of:

a) providing a surface of at least one metal, of at least one alloy or of a mixture of them, whereby at least one of the metals and alloys is anodizable that is used as one electrode;
b) contacting said metallic surface with an anodizing solution;
c) providing at least one other electrode in contact with said anodizing solution;
d) passing an electric current between said metallic surface and said other electrode through said anodizing solution; and
e) wherein said anodizing solution is an aqueous solution having a pH greater than 7 and comprising:
   i. phosphorus and oxygen containing anions;
   ii. at least one water-soluble inorganic hydroxide;
   iii. at least one surfactant; and
   iv. at least one alcohol showing at least one alkaline radical group or at least one alkaline hydrolyzed silane or a mixture of them.

Anodizable shall mean that there may be generated an anodizing coating on at least a part of the metallic surface which includes at least one oxide or at least one hydroxide or a mixture of them, especially an oxide or a hydroxide of the base metal of the metallic surface, and which is generated by an electrical process.

The workpiece is preferably used as an anode for direct current or as an electrode for alternative current. The other electrode should then be a cathode if direct current is used; then the workpiece will be the anode and the tank or the other electrode, e.g. a cathode hanging into the anodizing solution, will be used as the other electrode functioning as cathode. The use of direct current and a cathode as other electrode is preferred for this invention.

Preferably, the surface of the workpiece comprises a surface of at least one metal, of at least one alloy or of a mixture of them, of which at least a part of the metals, alloys or their mixtures is selected from the group consisting of magnesium, magnesium alloy, aluminum, aluminum alloy, titanium, titanium alloy, beryllium and beryllium alloy that is used as an electrode, at least partially.

BRIEF DESCRIPTION OF THE DRAWINGS

FIG. 3-*a* demonstrates a process where a stead burning of bigger local flames or a regional flame over the metallic surface occurs. FIG. 3-*b* demonstrates a process where a big local break-down of the coating occurs first, followed by many small break-downs.

DETAILED DESCRIPTION OF THE INVENTION

Figure 1:
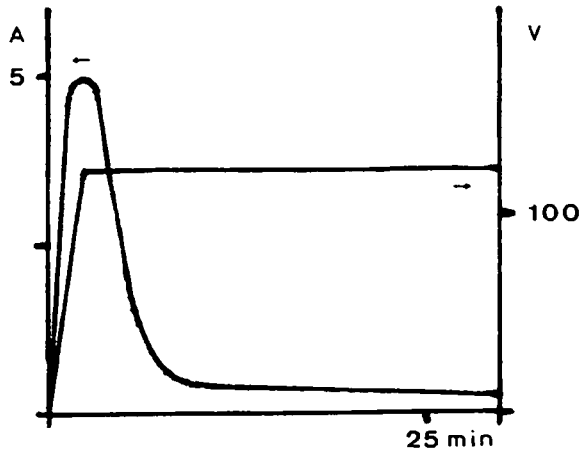
FIG. 1 shows the current changes using the controlled micro-sparking regime.

According to the teachings of the present invention there is provided an aqueous composition, especially an aqueous solution, useful for the anodizing especially of magnesium or a magnesium alloy surface the composition. The aqueous composition may be a solution or dispersion, often being a solution. This anodizing composition contains preferably phosphorus and oxygen containing anions, at least one surfactant, at least one water-soluble inorganic hydroxide and at least one constituent selected from the group consisting of alcohols comprising at least one alkaline radical group, of at least one hydrolyzed alkaline silane and a mixture of them in water having a pH greater than 7. It is especially favorable that the phosphorus and oxygen containing anions contain phosphate anions, e.g. orthophosphate anions. Preferably, the at least one alcohol contains at least one alcohol having at least one amino group.

According to a feature of the present invention, the phosphorus and oxygen containing anions are preferably selected from the group consisting of mono-, di-, tri-P atoms containing groups like in an orthophosphate, hydrophosphate or pyrophosphate and of a six P atoms containing group like in a hexametaphosphate.

According to a feature of the invention, the phosphate anions are preferably provided from at least one compound selected from the group consisting of $KH_2PO_4$, $K_2HPO_4$, $NaH_2PO_4$ and $Na_2HPO_4$, preferably added as water-soluble phosphate salt, especially in the range from 0.001 to 6.0 M.

The concentration of the phosphorus and oxygen containing anions in the anodizing solution is preferably in the range from 0.001 to 6.0 M (mols), especially at least 0.1 M, at least 0.3 M, at least 0.5 M, at least 0.7 M, at least 0.9 M, at least 1.2 M, up to 5.5 M, up to 5.2 M, up to 4.8 M, up to 4.2 M, up to 3.8 M, up to 3.5 M, up to 3.2 M, up to 2.8 M, up to 2.5 M, up to 2 M or up to 1.5 M, calculated as $PO_4$. Preferably, the concentration of phosphorus and oxygen containing anions is in the range from 0.01 to 100 g/L, especially at least 0.1 g/L, at least 0.5 g/L, at least 0.8 g/L. at least 1.2 g/L, at least 2 g/L, at least 3 g/L, at least 5 g/L, at least 8 g/L, at least 12 g/L, at least 16 g/L, at least 20 g/L, at least 25 g/L, at least 30 g/L, at least 40 g/L, at least 50 g/L, at least 60 g/L, at least 70 g/L, up to 95 g/L, up to 90 g/L, up to 85 g/L or up to 80 g/L, calculated as $PO_4$.

According to a feature of the present invention, at least one water-soluble inorganic hydroxide is added that may preferably comprise a content of $NH_4OH$, LiOH, NaOH, KOH or any mixture of them. The water-soluble inorganic hydroxide is preferably selected from the group consisting essentially of NaOH and KOH, consisting essentially of NaOH, consisting essentially of KOH, consisting only of NaOH, consisting only of KOH or consisting of a mixture of NaOH and KOH.

That said, the alkali metal hydroxide added is most preferred either KOH or NaOH or a mixture of them in a concentration of between 0.2 M and 4 M, especially at least 0.3 M, at least 0.5 M, at least 0.7 M, at least 0.9 M, at least 1.2 M, up to 3.8 M, up to 3.5 M, up to 3.2 M, up to 2.8 M, up to 2.5 M, up to 2 M or up to 1.5 M. The concentration of said water-soluble inorganic hydroxide is preferably in the range from 0.01 to 100 g/L, especially at least 0.1 g/L, at least 0.5 g/L, at least 0.8 g/L. at least 1.2 g/L, at least 2 g/L, at least 3 g/L, at least 5 g/L, at least 8 g/L, at least 12 g/L, at least 16 g/L, at least 20 g/L, at least 25 g/L, at least 30 g/L, at least 40 g/L, at least 50 g/L, at least 60 g/L, at least 70 g/L, up to 95 g/L, up to 90 g/L, up to 85 g/L, up to 80 g/L. If an aqueous solution is used with more than 100 g/L, the solution may become a more gel-like state.

The at least one surfactant is selected from the group consisting of amphoteric surfactants, anionic surfactants and non-ionic surfactants. The surfactant may be an oligomeric or polymeric compound. "Surfactants" shall mean any organic substance or preparation that may be used in detergents and that are added e.g. due to their surface-active properties and which comprise one or more hydrophilic and one or more hydrophobic groups of such a nature and size that they are capable of forming micelles.

The at least one non-ionic surfactant may be selected from ethoxylated alkylalcohols, ethoxylated-propoxylated alkylalcohols, ethoxylated alkylalcohols with end group locking and ethoxylated-propoxylated alkylalcohols with end group locking, ethoxylated alkylphenols, ethoxylated-propoxylated alkylphenols, ethoxylated alkylphenols with end group locking and ethoxylated-propoxylated alkylphenols with end group locking, ethoxylated alkylamines, ethoxylated alkanic acids and ethoxylated-propoxylated alkanic acids and block-copolymers as well as alkylpolyglucosides comprising at least one polyethylene oxide block and at least one polypropylene oxide block. According to one feature of the present invention the surfactant(s) may be at least one non-ionic surfactant having 3 to 100 monomeric groups selected from ethylene oxide, propylene oxide monomeric groups or their mixtures, especially with up to 300 carbon atoms or with up to 200 carbon atoms, whereby the long chain may be one chain, a double chain, a multiple of chains, a regular or an irregular arrangement of ethylene oxide monomeric groups, propylene oxide monomeric groups, a block copolymer or their combinations, whereby the chains may be straight chains without or with smaller or bigger side groups, whereby the surfactant may optionally have an alkyl group with 6 to 24 carbon atoms, most preferred polyoxyalkylene ethers.

According to a further feature of the present invention the surfactant(s) may be at least one non-ionic surfactant selected from alkylpolyglucosides having an alkyl group—saturated or unsaturated—with an average number of carbon atoms in the range from 4 to 18 in each chain and having at least one chain which may be independent one from the other a linear or a branched chain and having an average number of 1 to 5 units of at least one glucoside whereby the units of the at least one glucoside may be bound glycosidically to the alkyl group.

Preferably, said surfactant is a non-ionic surfactant having 3 to 100 monomeric groups selected from the group consisting of ethylene oxide monomeric groups and propylene oxide monomeric groups, especially with up to 300 carbon atoms, whereby the long chain may be one chain, a double chain, a multiple of chains, a regular or irregular arrangement of ethylene oxide monomeric groups, propylene oxide monomeric groups, a block copolymer or their combinations, whereby the chains may be straight chains without or with bigger side groups, whereby the surfactant may optionally have an alkyl group with 6 to 24 carbon atoms, especially with 8 to 20 carbon atoms. More preferred, said surfactant is a polyoxyalkylene ether, most preferred a polyoxyethylene ether selected from the group consisting of polyoxyethylene oleyl ethers, polyoxyethylene cetyl ethers, polyoxyethylene stearyl ethers, polyoxyethylene dodecyl ethers, such as polyoxyethylene(10)oleyl ether—commercially sold as Brij® 97.

According to one feature of the present invention the surfactant(s) may be at least one anionic surfactant a) having an alkyl group—saturated or unsaturated—with an average number of carbon atoms in the range from 6 to 24 in each chain and having at least one chain which may be independent one from the other a linear or a branched chain and having optionally an alkyl part of the molecule with one or more aromatic groups and having at least one sulfate group per molecule, at least one sulfonate group per molecule or at least one sulfate group as well as at least one sulfonate group per molecule or b) (ether sulfates) which ethoxylated alkylalcohols resp. ethoxylated-propoxylated alkylalcohols having a sulfate group whereby the alkyl group of the alkylalcohols—saturated or unsaturated—with an average number of carbon atoms in the range from 6 to 24 in each chain and having at least one chain which may be independent one from the other a linear or a branched chain and whereby each ethylene oxide chain may have an average number of 2 to 30 ethylene oxide units, whereby there may be at least one propylene oxide chain having an average number of 1 to 25 propylene oxide units, whereby the alkyl part of the molecule may optionally show one or more aromatic groups, one or more phenolic groups or a mixture of at least one aromatic group and at least one phenolic group or c) (ether phosphates) which ethoxylated alkylalcohols resp. ethoxylated-propoxylated alkylalcohols having a phosphate group whereby the alkyl group of the alkylalcohols—saturated or unsaturated—with an average number of carbon atoms in the range from 6 to 24 in each chain and having at least one chain which may be independent one from the other a linear or a branched chain and whereby each ethylene oxide chain may have an average number of 2 to 30 ethylene oxide units, whereby there may be at least one propylene oxide chain having an average number of 1 to 25 propylene oxide units, whereby the alkyl part of the molecule may optionally show one or more aromatic groups, one or more phenolic groups or a mixture of at least one aromatic group and at least one phenolic group or d) (phosphate esters) which one or two alkyl groups each independent one from the other—saturated or unsaturated—having an average number of carbon atoms in the range from 4 to 18 in each chain and having at least one chain which may be independent one from the other a linear or a branched chain and whereby the alkyl part of the molecule may optionally show one or more aromatic groups, one or more phenolic groups or a mixture of at least one aromatic group and at least one phenolic group, whereby there is one phosphate group in each molecule.

According to another feature of the present invention the surfactant(s) may be at least one amphoteric surfactant which may be selected from the group consisting of amine oxides, betaines and protein hydrolyzates.

More preferred, the at least one surfactant shows at least one alkyl group with an average number of carbon atoms of at least 8, of at least 10 or of at least 12, much more preferred with an average number of carbon atoms of at least 14, of at least 16 or of at least 18, especially in some cases with an average number of carbon atoms of at least 20, of at least 22 or even of at least 24. Further on it is preferred to select a surfactant which shows more polymer-like properties, e.g. shows in high concentration a high viscosity.

According to a feature of the present invention, the concentration of the surfactant in the anodizing solution is preferably in the range from 0.005 to 3 g/L, especially at least 0.01 g/L, at least 0.05 g/L, at least 0.1 g/L. at least 0.2 g/L, up to 2.5 g/L, up to 2 g/L, up to 1.5 g/L or up to 1 g/L. Mostly, there will be not used more than 1 g/L of the surfactant in the anodizing solution, especially, if there will be the need to coat the anodizing coating with a paint layer as there may be the risk of a low paint adhesion. In other cases, it is generally possible to use of up to about 10 g/L of such substance.

According to a feature of the present invention, the at least one alcohol having at least one alkaline radical group is selected from the group consisting of alkaline compounds showing at least one amido group, at least one amino group, at least one imino group, at least one imido group, at least one ureido group or any mixture of them, preferably at least one compound selected from the group consisting of mono-, di- or tri-alkanolamines, more preferred selected from the group consisting of amino-methyl propanol, amino-ethyl propanol, 2-amino-2-methyl-1-propanol, and amino-propyl propanol. The alcohol is favorably selected from stronger or very strong alkaline alcohols, preferably showing in an aqueous solution a pH of at least 10.

The anodizing composition may contain an amount of an alcohol having at least one alkaline radical group, a hydrolyzed alkaline silane or a mixture of them, preferably the concentration a) of said alcohol is between 1 ml/l and 100 ml/l or b) of said hydrolyzed alkaline silane is between 1 ml/l and 50 ml/l or both said alcohol and said hydrolyzed alkaline silane are present in those concentrations. The silane may be an oligomeric or polymeric compound.

The concentration of said at least one alcohol showing at least one alkaline radical group in said anodizing solution is preferably in the range from 1 ml/l to 100 ml/l, especially at least 2 ml/l, at least 4 ml/l, at least 6 ml/l, at least 8 ml/l, at least 10 ml/l, at least 12 ml/l, at least 14 ml/l, at least 16 ml/l, up to 95 ml/l, up to 90 ml/l, up to 85 ml/l, up to 80 ml/l, up to 75 ml/l, up to 70 ml/l, up to 65 ml/l, up to 60 ml/l, up to 55 ml/l, up to 50 ml/l, up to 45 ml/l, up to 40 ml/l, up to 35 ml/l, up to 30 ml/l or up to 25 ml/l. The concentration of said alcohol showing at least one alkaline radical group in said anodizing solution is preferably in the range from 1 g/L to 100 g/L, especially at least 1.5 g/L, at least 2 g/L, at least 3 g/L, at least 5 g/L, at least 8 g/L, at least 12 g/L, at least 16 g/L, up to 95 g/L, up to 90 g/L, up to 85 g/L, up to 80 g/L, up to 75 g/L, up to 70 g/L, up to 65 g/L, up to 60 g/L up to 55 g/L, up to 50 g/L, up to 45 g/L, up to 40 g/L, up to 35 g/L, up to 30 g/L or up to 25 g/L. Its concentration of amino-methyl propanol in the anodizing solution is more preferred in the range from 1 ml/l to 100 ml/l.

Said hydrolyzed alkaline silane is selected from the group consisting of silanes, silanols and siloxanes corresponding to silanes having at least one amino group, having at least one imino group or at least one ureido group. The silanes will mostly be hydrolyzed to silanols and will form siloxanes, especially during drying.

According to a further feature of the present invention the hydrolyzed alkaline silane is preferably selected from aminosilanes, especially from silanes having at least one amino group, at least one imino group or at least one ureido group or a combination of at least two different groups as mentioned. More preferred, said hydrolyzed alkaline silane is selected from the group consisting of:

aminoalkyltrialkoxysilanes,
aminoalkylaminoalkyltrialkoxysilanes,
triaminofunctional silanes,
bis-trialkoxysilylalkylamines,
(gamma-trialkoxysilylalkyl)dialkylentriamin,
N-(aminoalkyl)-aminoalkylalkyldialkoxysilanes,
N-phenyl-aminoalkyltrialkoxysilanes,
N-alkyl-aminoisoalkyltrialkoxysilanes,
4-amino-dialkylalkyltrialkoxysilanes,
4-amino-dialkylalkylalkyldialkoxysilanes,
polyaminoalkylalkyldialkoxysilan
ureidoalkyltrialkoxysilanes and
their corresponding silanols and siloxanes.

Much more preferred, said alkaline hydrolyzed silane is selected from the group consisting of:

Aminopropyltriethoxysilane,
aminopropyltrimethoxysilane,
triaminofunctional silane,
bis-trimethoxysilylpropylamine,
N-beta-(aminoethyl)-gamma-aminopropylmethyldimethoxysilane,
N-phenyl-aminopropyltrimethoxysilane,
N-ethyl-gamma-aminoisobutyltrimethoxysilane,
4-amino-3,3-dimethylbutyltrimethoxysilane,
4-amino-3,3-dimethylbutylmethyldimethoxysilane,
ureidopropyltriethoxysilane,
ureidopropyltrimethoxysilane as well as
their corresponding silanols and siloxanes.

Most preferred, the at least one alkaline hydrolyzed silane is chosen from the group consisting of aminopropyltriethoxysilane, aminopropyltrimethoxysilane, ureidopropyltrimethoxysilane, bis-trimethoxysilylpropylamine as well as their corresponding silanols and siloxanes of preparing an anodizing solution of the present invention as described herein above by mixing the necessary constituents.

The concentration of the hydrolyzed alkaline silane in the anodizing solution is preferably in the range from 1 ml/l to 50 ml/l, especially at least 0.5 ml/l, at least l/l, at least 2 ml/l, at least 4 ml/l, at least 6 ml/l, at least 8 ml/l, at least 10 ml/l, at least 12 ml/l, at least 14 ml/l, at least 16 ml/l, up to 95 ml/l, up to 90 ml/l, up to 85 ml/l, up to 80 ml/l, up to 75 ml/l, up to 70 ml/l, up to 65 ml/l, up to 60 ml/l, up to 55 ml/l, up to 50 ml/l, up to 45 ml/l, up to 40 ml/l, up to 35 ml/l, up to 30 ml/l or up to 25 ml/l. The concentration of the hydrolyzed alkaline silane in the anodizing solution is preferably in the range from 0.1 g/L to 50 g/L, especially at least 0.5 g/L, at least 0.8 g/L. at least 1.2 g/L, at least 2 g/L, at least 3 g/L, at least 5 g/L, at least 8 g/L, at least 12 g/L, at least 16 g/L, at least 20 g/L, up to 45 g/L, up to 40 g/L, up to 35 g/L, up to 30 g/L or up to 25 g/L.

Nevertheless, there are a lot of possible variations of the compositions of the present invention by adding at least one further component. Such components may be:

There may be added at least one surfactant, e.g. a non-ionic, an anionic or a cationic surfactant. There may be added alternatively or additionally at least one oligomer, polymer or their mixtures which may be each organic or inorganic, e.g. on the base of amorphous silicas, amorphous silicates, silanes, siloxanes, polysiloxanes, fluor containing polymers like PTFE, molybdenum compounds, niobium compounds, titanium compounds, tungsten compounds, zirconium compounds, organic resins like acrylic constituents containing resins or resin mixtures, electrically conductive polymers or their mixtures like compounds on the base of polypyrrol.

Further on, there may be an addition of inorganic compounds like molybdenum compounds, niobium compounds, titanium compounds, tungsten compounds, zirconium compounds or their mixtures. Nevertheless, it is more preferred to add only small or even no components that are environmentally unfriendly. It may be preferred not to add any other component than those mentioned under the groups i. to iv. intentionally. On the other hand, there may be small amounts of impurities coming from chemical reactions with the workpieces, with the apparatuses and tubes, with the electrodes and from the drag in from other tanks.

According to a feature of the present invention, the pH of the anodizing solution is preferably at least 7.5, at least 8.0, at least 8.5, at least 9.0, at least 9.5, at least 10.0, at least 10.5, at least 11.0, at least 11.5 or at least 12.0. The pH may be in some cases smaller than 14.0, smaller than 13.5, smaller than 13.0 or smaller than 12.5. But the ranges of the pH of the anodizing solution may be varied depending on the types of metallic surfaces.

According to a still further feature of the invention, the pH of the anodizing solution is preferably greater than 9, more preferred above 10 and even much more preferred about or above 11. The pH is preferably mostly achieved by the addition of at least one hydroxide. That said, the alkali metal hydroxide added is preferably either KOH or NaOH or a mixture of them e.g. in a concentration in the range from 0.2 M to 4 M. Nevertheless, there may occur significant differences in some cases to the process conditions.

Nevertheless, there may occur significant differences in some cases to the process conditions. It has been found that for A15053 and A16061 the pH used for the anodizing solution should preferably be in the range of from 7 to 9. This preferred range seems to be applicable for all surfaces of aluminum and aluminum alloys. Whereas for magnesium surfaces, the pH used for the anodizing solution should preferably be in the range of from 8 to 14, more preferred ≥9, much more preferred in some cases ≥10.

There is also provided according to the teachings of the present invention a method of treating a workpiece having a surface e.g. of magnesium, magnesium alloys, aluminum or aluminum alloys, immersing the surface in an anodizing solution, providing a cathode in the anodizing solution and passing a current between the surface and the cathode through the anodizing solution wherein the anodizing solution is substantially as described immediately herein above.

In general, when aluminum surfaces, magnesium surfaces or combinations of these are anodized according to the methods known in the art, sparking occurs. The sparking will often form large pores on the anodized surface, e.g. of up to about 0.5 mm diameter, rendering the surface susceptible to corrosion and for some applications, unaesthetic. In contrast, when the anodizing of the present invention is performed in the sparking regime, pores are very small, typically not visible on the surface of the anodizing coating with the naked eye.

Since the electrical parameters of the anodizing process are dependent on many factors including the exact composition of the bath, the shape of the bath and the size and shape of the workpiece itself, the exact details of the electrical current are not generally critical to the present invention and are easily determined, without undue experimentation, by one skilled in the art performing anodizing as described herein.

According to a feature of the present invention the current density at any given anodizing potential can be chosen so as to be enough to reach the controlled micro-sparking regime—which generally occurs at a current density ≤10 A/dm2. The term "sparking regime" shall mean that micro-plasma arcs are observed on the anodizing surface during the anodizing process, especially as small sparks, often small blue sparks similar to neon lights, e.g. of up to 3 mm length each. Typically, the "sparking regime" is dependent on the electrical conditions, which means for this invention that it is combined with the typical ranges of current density. The term "controlled micro-sparking regime" shall mean that the micro-plasma arcs do not provide significant break-downs in the anodizing coating which can have negative influence on corrosion resistance.

As it is clear to everyone skilled in the art, it is necessary to control the potential of the current during the anodizing process. If the potential is very low, e.g. at about 40 V, no anodizing occurs. In contrast, a high potential leads to an excessive heating of the workpiece. Experiments did show that effective anodizing begins at a minimum of about 50 V. Above about 500 V the heating of the workpiece is intense and may sometimes even damage the workpiece. The smaller the metallic sample that is to be anodized, the smaller may be the voltage. As a guideline, a potential in the range from 70 V to 300 V has been found to be suitable for the anodizing according to the process of the present invention. These ranges are the same for AC and DC applications. But generally, the alternative current will need about twice the anodizing time.

The anodizing method of the present invention involves immersing or contacting a workpiece in another way like spraying having e.g. a magnesium alloy surface in an anodizing solution of the present invention and allowing the surface to act as an anode of an electrical circuit with direct current (DC) or as an electrode with alternative current (AC). Applied through the circuit is a DC or an AC or a pulsed current.

Further on, it is also clear to everyone skilled in the art to control the current density during an anodizing process. The current density may be varied between 0.01 A/dm$^2$ and 180 A/dm$^2$, preferably between 0.1 A/dm$^2$ and 50 A/dm$^2$, more preferred of at least 0.2 A/dm$^2$ or up to 30 A/dm$^2$, most preferred of at least 0.3 A/dm$^2$ or up to 12 A/dm$^2$. The range between 0.5 A/dm$^2$ and 50 A/dm$^2$ seems to be generally suitable. These ranges are the same for AC and DC applications. Especially for a method to prepare a smooth surface, especially for a method to prepare a surface of high corrosion resistance or for both methods it is very favorable to use a current density of no more than 4 A/dm$^2$.

Preferably, the electrical conditions for the anodizing are used in the following way: The voltage may be raised to a certain value and may be kept then at a constant or nearly constant level. But the current may be raised quickly up to a high value with a maximum and may then be reduced continuously, especially like generating a peak curve, leading to a relative low final value. This may be the same for AC and DC applications. Beside this way, there are other possibilities to use a voltage change.

In some industrial applications, the voltage may start from 0 V and may be increased during the anodizing process continuously and the current may be kept preferably all the time at a constant level or at a nearly constant level. These electrical conditions or similar electrical conditions may be used in the process according to the invention successfully. The coatings generated with such electrical conditions will be the same or nearly the same like the coatings generated with the electrical conditions mentioned before. This may be the same for AC and DC applications.

The anodizing conditions according to the controlled micro-sparking regime may be reached on different ways. One easily used way is to increase the voltage and essentially proportional to it the current, until a maximum of the current and a maximum of the voltage, then keep the voltage e.g. essentially constant, whereas the current may go down. The curve of this current decrease should preferably be continuously falling down, without bigger or even without any small peaks and without reaching zero within an anodizing time of e.g. less than 30 minutes. This may happen with alternative current, direct current or current with any pulses. For a small tank for anodizing, the voltage may preferably be in the range from 100 to 260 V, more preferred in the range from 125 to 230 V, much more preferred in the range from 150 to 200 V. For such a small tank for anodizing, the maximum of the current may preferably be in the range from 2.0 to 6.0 A, more preferred in the range from 2.5 to 5.5 A, much more preferred in the range from 3.0 to 5.0 A, especially in the range from 3.5 to 4.5 A. There will occur micro-sparking, but essentially no flames and essentially no break-downs of the coating, except where there are inhomogeneities or impurities in the metallic surface. Within an anodizing time of e.g. 10 minutes, an anodizing coating will be generated of a thickness of e.g. 15 to 20 μm. Within an anodizing time of e.g. 30 minutes, an anodizing coating will be generated of a thickness of e.g. 40 to 50 μm. The controlled micro-sparking regime may preferably be used for an anodizing time in the range from 5 to 40 minutes, more preferred in the range from 7 to 32 minutes, much more preferred in the range from 10 to 25 minutes, in many cases in the range from 12 to 20 minutes. The micro-sparking is often accompanied by a very low noise. FIG. 1 describes such a method for using the controlled micro-sparking regime. The figures reveal few of the possible variations.

Figure 2:
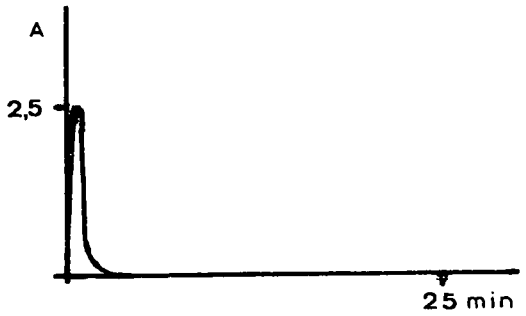
FIG. 2 shows the current changes with inadequate chemical conditions or anodizing conditions.

If the anodizing conditions are too low or if the chemical conditions are inadequate e.g. by using $NH_4OH$ instead of KOH, the controlled micro-sparking regime will not be reached and often there will be no sparking, as it is difficult to reach the sparking regime with inadequate chemical conditions except with very high voltages. Then, the current will often reach its maximum in a range from 1.0 to 2.0 A in a time of already 1 to 2 minutes from the starting point at zero voltage and zero current. Typically, the current peak is very slim and the current falls down very steep, ending at zero current often after even 2 to 3 minutes. There is no or only a very thin anodizing coating, which partly reaches a coating thickness of 2 to 3 μm already in this short time and is afterwards no more increasing. FIG. 2 indicates the current changes.

Figure 3:
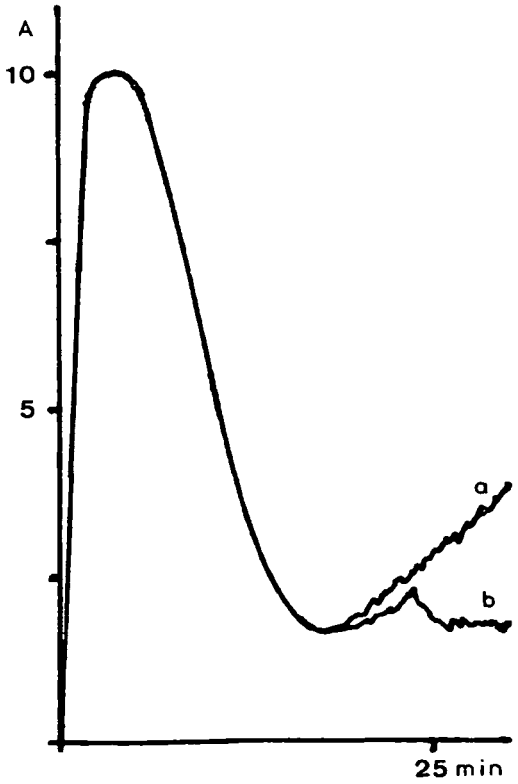
FIG. 3 shows possible current developments with excessive anodizing conditions.

If the anodizing conditions are too strong, the controlled micro-sparking regime will not be reached as there will be flames instead of micro-sparks (FIG. 3-*a*)) generating much light and often accompanied by strong noise or there will be break-downs of the coating (FIG. 3-*b*)) or both effects. Then, the current will often reach its maximum in a range from 5.0 to 20.0 A in a time of few minutes from the starting point at zero voltage and zero current. But the current peak is much broader. Typically, the current remains in a higher level after the early very big peak then for the conditions of the controlled micro-sparking regime. When there are flames or break-downs of the coating or even both at the same time, then there will be many tiny or even one or some very big broad peaks indicating the instable electrical conditions. There will occur a lot of big pores and of spots or areas where at least part of the anodizing coating is damaged or decomposed. There may even occur a steady burning of the flames. The porous coating may reach a thickness in the range from 40 to 120 μm. It has often a bad adhesion. FIG. 3 shows possible current developments. FIG. 3-*a*) indicates a process where there may occur a steady burning of bigger local flames or a regional flame over a small or big portion of the metallic surface. FIG. 3-*b*) characterizes a process where there may occur first a big local break-down of the coating followed by many small break-downs.

The anodizing coating prepared according to the invention, especially according to the controlled micro-sparking regime, may have an average coating thickness in the range from 2 to 50 μm, preferably in the range from 5 to 40 μm, especially preferred in the range from 8 to 25 μm.

According to one feature of the present invention the temperature of the anodizing solution is maintained (e.g. by cooling) to be between 0° C. and 70° C., preferably between 5° C. and 60° C., more preferred between 10° C. and 50° C., much more preferred between 20° C. and 40° C. Especially preferred is a temperature in the range of from 12° C. to 48° C., more preferred is a temperature in the range of from 15° C. to 45° C. Practically it may be preferred to start the anodizing at room temperature. During the anodizing, the temperature will typically continuously increase so that it may be preferred to start any cooling e.g. by cooling the anodizing solution circulated into a heat exchanger, by introducing a heat exchanger into the tank or by cooling the tank e.g. with cool water.

Magnesium alloys include but are not limited to AM50A, AM60, AS41, AZ31, AZ31B, AZ61, AZ63, AZ80, AZ81, AZ91, AZ91D, AZ92, HK31, HZ32, EZ33, M1, QE22, ZE41, ZH62, ZK40, ZK51, ZK60 and ZK61. Nevertheless, the method and the composition according to the invention may be applied for other metals and alloys than magnesium and magnesium-containing alloys, alone or simultaneously. Preferred metallic surfaces beside magnesium surfaces are aluminum, aluminum alloys, beryllium, beryllium alloys, titanium and titanium alloys. Especially preferred are the aluminum alloys Al 2024, Al5051, Al5053, Al6061 and Al7075.

There may be a treatment of the surface of the workpiece with at least one cleaning solution, with at least one deoxidizer solution or with at least one cleaning solution and with at least one deoxidizer solution prior to contacting the surface with the anodizing solution. In between, there may be at least one rinsing with water, especially with very pure water qualities.

There may be a treatment of the surface of the workpiece with at least one further applied coating selected from the group consisting of coatings prepared from a solution containing at least one acid or from an alkaline solution containing e.g. at least one silane, prepared from a paint, prepared from a dispersion or solution containing at least one resin, prepared from a powder paint and prepared from electroless deposited metal like nickel rich coatings after the generation of the anodizing coating.

Preferably, a method of treating the surface of a metallic workpiece having at least on a portion of the metallic surface an anodizable material is used whereby the method comprises the steps of:

a) providing a surface of at least one metal, of at least one alloy or any combination of them, whereby at least one of the metals and alloys is anodizable that is used as an anode;
b) contacting said metallic surface with an anodizing solution;
c) providing at least one other electrode in contact with said anodizing solution; and
d) passing an electric current between said metallic surface and said other electrode through said anodizing solution as an alternative current, a direct current or a current pulsed in any way,
e) wherein a layer containing at least one non-conductive polymer is generated on the metallic surface in the earliest stage of the anodizing,
f) wherein the non-conductive polymer containing layer on the metallic surface provides an essential contribution in the initiation of the formation of micro-plasma arcs,
g) wherein the non-conductive polymer containing layer is transformed to a gel layer in which gel micelles are oriented according to the electromagnetic field,
h) wherein micro-plasma arcs are generated during anodizing,
i) whereby the micro-plasma arcs are provided as controlled micro-sparking regime,
j) wherein there is essentially no break-down of the coating or wherein there is essentially no formation of big pores—except in cases where impurities or inhomogeneities in the metallic surface cause a break-down or the formation of a big pore or both,
k) wherein the gel micelles are—at least partially—kept on distance one to the other,
l) wherein there are channels or gaps more or less directed rectangular to the metallic surface between at least some of the micelles,
m) wherein these channels or gaps are at least partially prevented to close during the anodizing and
n) wherein the anodizing layer is built up during the anodizing by decomposition of the gel layer and by oxidation of parts of the metallic surface.

The unique composition of the anodizing solution of the present invention allows the creation of an excellent anodizing coating—even under sparking conditions. In accordance with the Plasma Oxidation Theory of an anodizing process, followed and supplemented by the inventor, any anodizing process may have a stage of gel formation. The pore sizes depend on many parameters, e.g. of the thickness of the coating, of the temperature of the electrolyte (=anodizing solution) and of the specific electrical parameters (=electrical regime).

Preferably, the metallic surface shows a magnesium content which may be at least one alloy containing magnesium or at least one magnesium alloy or magnesium or a combination of these. The electrically non-conductive polymer containing layer may contain at least one organic polymer or at least one polyphosphate or at least one silicon containing polymer or at least one other derivate of these compounds or a mixture of these polymers whereby the at least one silicon containing polymer is selected from the group consisting of a silane, a silanol, a siloxane, a polysiloxane, an amorphous silicate or at least one other derivate of these compounds. The non-conductive polymer may be any electrically non-conductive oligomeric or polymeric compound. Therefore, its polymerization degree may often be quite low or medium. A polyphosphate as well as any other polymer present during the anodizing may be formed—at least partially—in the anodizing solution. The polymer containing layer is generated especially by absorption on the metallic surface.

Said anodizing is performed by control of the sparking to be a micro-sparking where there is preferably no break-down of the coating or preferably no generation of big pores—with the exclusion for the mentioned exceptions. The wording "control" is primarily directed to the control of the electrical conditions together with the control of the formation of the anodizing coating. The term "break-down of the coating" means a spot or area where the metallic surface was already at least partially coated and where the anodizing caused at least partial destruction.

During the anodizing, plasma arcs and a gel micelles containing gel layer are generated. The gel micelles are present when current is applied and when there is an electrical field. The ability of alcohols and silanols to adsorb on gel particles and to stabilize the gel is known from the theory of sol-gel processes, but unknown in anodizing technology. The process of gel stabilization helps to prevent large sparks and allows to build compact anodizing coatings having only small pores or having predominantly small pores. The gel micelles may be at least partially kept on distance one to the other micelle e.g. by the addition of at least one stabilizator like at least one alcohol, at least one surfactant, their derivate(s) or any mixture of these. This stabilizator may be absorbed on the micelles and may help to keep the micelles one to the other on distance. Especially the at least one stabilizator helps to prevent the closure of the channels at least partially between the micelles during the anodizing.

The thermal energy of said micro-sparking may be used to form and to build up the oxide layer on the metallic surface. The energy of the sparking and the sparks may lead to the decomposition of the hydroxides which normally build up during the anodizing and the hydroxides are reacted to oxides which have a better corrosion and wear resistance than the hydroxides. This oxide layer is not a typical ceramic type coating as the temperatures at the surface of the coating are not high enough to sinter the oxides all over the anodizing coating. There may be in many cases no sintering of the oxides, whereas in other cases there may be sintered spots or sintered regions or other forms of a beginning sintering. This anodizing coating may contain a mixture of phases selected from the group consisting of oxides, hydroxides and phosphates, whereby the phosphate will often be at least one orthophosphate. With a current density of about 4 A/dm2, there is often practically no sintering of this mixture. Whereas at 10 $A/dm^2$, there is often a certain beginning of sintering or stronger sintering to be seen. For the method according to the invention, a current density preferably in the range from 0.01 $A/dm^2$ to $\leq 12$ $A/dm^2$ can be used.

It was astonishing that even without any addition of any silicon compound a controlled micro-sparking regime could be reached on aluminum and aluminum alloys as well as on magnesium and magnesium alloys.

Preferably, the sparking is chemically controlled by the selection of suitable compounds, contents of such compounds and respective compositions. The coating should preferably be generated with a micro-sparking process where the micelles of the coating gel are essentially kept on distance one to the other on the surface of the metallic workpiece. Such a process will be improved by the addition of stabilizing compounds that may be absorbed on the micelles of the coating gel and help to keep the micelles on distance one to the other on the surface of the metallic workpiece because they prevent to close the channels and gaps between the micelles. Compounds like alcohols or silanes may be stabilizers for this process.

The influence of the composition on the anodizing conditions: The anodizing composition of the present invention is alkaline, preferably having a pH above 7. Although many bases may be used to ensure that the pH of the anodizing solution is of the desired value, it is preferred to use an anodizing solution having a content of NaOH or KOH or a content of NaOH together with KOH. Of these two hydroxides, KOH is more preferred. Experiments have shown that the sodium and potassium ions are integrated into the anodizing coatings of the present invention. Although not wishing to be held to any one theory, it is believed that the presence of the sodium and potassium ions in an anodized solution of the present contribute to the exceptionally properties of the non-conductive polymer containing layer and help significantly to initiate micro-sparking. It has been found that anodizing solutions with potassium ions generate significantly better anodizing coatings because of smaller sparks. It has been found that by using at least a portion of KOH, NaOH or their mixtures, it is easier to reach the micro-sparking regime than with other hydroxides. Further on, it has been found that the micro-sparking regime could be already reached with a voltage of about 50 V or under other conditions of at least 90 V or at least 120 V, whereas an addition of $NH_4OH$ may cause a voltage of about 500 V. Thus it is preferred to use the method according to the invention with voltages in the range of from 100 to 300 V, more preferred in the range of up to 250 V, much more preferred in the range of up to 200V. Voltages especially in the range from 100 to 250 V, preferably in the range of up to 200 V, are especially preferred as there is no special equipment necessary because of high voltages and corresponding required protection and as the costs even for the process are significantly reduced. But these minimum voltages depend much on the conditions and size of the metallic surfaces and of the electrical conductivity of the anodizing composition used. To get these results, it is further preferred to have a minimum of 0.2 M alkali metal hydroxide. It has been experimentally observed that assuming that the desired pH is achieved, concentrations of greater than 4 M alkali metal hydroxide may not be desirable as the electrical conductivity of the solution may be reduced to the point where excessive heating of the workpiece is observed.

Pentanol may have the best stabilizing ability in the group of primary alcohols. The amino group in amino-methyl propanol offers additionally the property of a high alkaline buffer. This property may also be important for the composition of the anodizing composition in the present invention. However, it is clear to the expert in the art that also at least one (other) primary alcohol or any other alcohol like any secondary alcohol or like any tertiary alcohol or any mixture of at least two alcohols may be used. For example, this other compound may be an alcohol with at least one amino, imino, amido or imido group or their mixtures, can be used in the anodizing solution of the present invention, especially amino-alkyl alcohols, imino-alkyl alcohols, amido-alkyl alcohols imido-alkyl alcohols and any mixture of these types of alcohols.

Further on, the silicon containing compound included into an anodizing coating by the presence of a hydrolyzed alkaline silane in the anodizing composition improves the wear resistance.

Furthermore, the surfactant(s) absorbed in the pores of the anodizing coating show(s) properties of a sealing agent and improve(s) the corrosion resistance.

Preferably, the anodizing coating has a composition comprising at least one metal compound selected from metal phosphate, metal oxide and metal hydroxide whereby the metal is selected from the chemical elements contained in the metallic surface, especially the base metal(s), and comprising further at least one oligomeric or polymeric compound and optionally at least one silicon-containing component like any silicon dioxide, at least one alkaline metal containing phosphate or mixtures of them. The base metals and their compounds are preferably aluminum, beryllium, magnesium, titanium and their corresponding phosphates, oxides and hydroxides. Besides the metal compounds on the base of the base metal(s) contained, there may occur metal compounds of at least some of the other constituents of the metallic materials of the metallic surface, especially compounds reacted from the further metal, half metal and nonmetal constituents of the alloys and perhaps even minor contents or traces reacted from impurities. In cases that the metallic surface or the anodizing composition or both contain magnesium, the coating may have a composition comprising at least one magnesium compound selected from magnesium phosphate, magnesium oxide and magnesium hydroxide and comprising further at least one polymer and optionally at least one silicon-containing component like any silicon dioxide, at least one alkaline metal containing phosphate or a mixture of them. Much more preferred, it may have a composition comprising magnesium phosphate, magnesium oxide, magnesium hydroxide, at least one polymer and at least one compound reacted from at least one silane. Favorably, it may have a composition comprising at least 50% by weight of at least one magnesium compound, preferably at least 60% by weight, more preferred at least 70% by weight, especially at least 80% by weight or at least 90% by weight.

The corrosion resistance of the anodizing coatings according to the invention reached the very high requirements of standard MIL-A-8625F Type II that is defined for aluminum materials, but used here for magnesium and magnesium alloys too without using any pretreatment of the magnesium rich surface except the steps of cleaning, deoxidizing, pickling and rinsing before the anodizing or their combinations or their repetitions and without any posttreatment after the anodizing like any sealant, any silane coating or any paint. The conditions were applied in accordance with this standard: For an anodizing coating with a thickness of about 10 or about 12 μm, the corrosion resistance measured according to this standard reached the standard requirements without any special conditions and without any further coating applied on the anodizing coating, although a posttreatment after the anodizing like a sealant or a paint coating is always used with other anodizing solutions tested to be able to reach the this standard. Typically, all anodized magnesium and magnesium alloys for such test not generated according to the method of this invention reach these standard conditions only with an additional sealant.

An anodizing coating according to the invention having a thickness in the range from 8 to 30 μm—especially in the range from 10 to 20 μm—generated in an anodic anodizing process formed on a surface of magnesium or of a magnesium alloy that is not sealed with another coating (bare corrosion) has a corrosion resistance of less than 1% area of corrosion on the flat surface after at least 300 h or after at least 336 h of exposition in 5% NaCl salt spray test according to ASTM 117, preferably less than 1% of corrosion under these conditions for an exposition time of at least 360 h, of at least 400 h, of at least 480 h or of at least 560 h. The best comparable anodizing coatings known to the inventor formed on a surface of magnesium or of a magnesium alloy show a corrosion resistance of less than 1% area of corrosion on the flat surface after up to 240 h of exposition in 5% NaCl salt spray test according to ASTM 117, but after 300 h of such testing the corroded are would already be significantly above 1% area of corrosion.

It was very astonishing that the anodizing coatings generated with the process according to the invention showed a much better bare corrosion resistance e.g. for any magnesium or magnesium alloy without any posttreatment of the anodized magnesium alloy with a sealant like a silane containing solution or a paint like an e-coat than any other anodizing coating on such alloys known to the inventor.

It was further astonishing that with the process of this invention the anodizing coatings generated with a controlled micro-sparking where there are no high sparks and essentially no sparks causing break-down of the coating or leading to big pores had an excellent visual decorative appearance, homogeneity and smoothness on magnesium or magnesium alloys. These coatings according to the invention formed on magnesium or magnesium alloys were, as tested, at least as good as such coatings according to the invention formed on aluminum or aluminum alloys concerning visual decorative appearance, homogeneity, smoothness as well as corrosion resistance and paint adhesion. Therefore, this process is even excellent for the use of metallic surfaces mixed from magnesium and aluminum materials.

Normally, anodizing coatings are generated with an addition of environmentally unfriendly compounds like at least one fluoride, at least one heavy metal compound or their mixtures. Further on, such coatings are often generated with an anodizing solution showing an amount of ammonium which may lead to undesirable smell of the bath and the coated workpieces so that special equipment is preferred, even because of environmentally unfriendly compounds generated in the process.

Typically, anodizing solutions for magnesium and magnesium alloys without a high content of environmentally unfriendly compounds like fluoride or heavy metal compounds or their mixtures lead to 1. coating break-downs or big pores or both, 2. low corrosion resistance as well as 3. porous and inhomogeneous coatings or lead even to problems to generate any coating as typically fluoride, heavy metal compounds like chromium, molybdenum or zirconium have to be present in the anodizing composition for the anodizing process. If there is only a low content of such environmentally unfriendly compounds, it has been observed that the coating quality is significantly reduced in comparison to well anodized coatings.

It was astonishing that high quality anodizing coatings could be generated in a low-cost industrially applicable process, especially leading to a high corrosion resistance, without any addition of environmentally unfriendly compounds or compounds that may generate smelling and environmentally unfriendly compounds during the anodizing. A low addition of such environmentally unfriendly compounds may lead to a slight improvement of the hardness and wear resistance, but not of the corrosion resistance of the coating.

It was astonishing that even without any addition of any silicon compound a controlled micro-sparking regime could be reached on aluminum and aluminum alloys as well as on magnesium and magnesium alloys.

EXAMPLES AND COMPARISON EXAMPLES

Examples 1 to 13

Preparation of the Anodizing Solutions 1 to 20 and Anodizing Trials

An amount of $Na_2HPO_4.2H_2O$ was dissolved in 500 ml of water. To this solution, an amount of a 95% by weight solution of amino-methyl propanol was added and thoroughly mixed. Then, KOH was added to this solution and again thoroughly mixed. Further on, an amount of a surfactant like Brij® 97, a product of Aldrich, was added to this solution. Finally, water was added to adjust the solution to 1 liter of an anodizing solution of the present invention. In some of these examples, an alkaline silane was added as a pre-hydrolyzed solution, partly instead of amino-methyl propanol. In some examples, the alcohol, the surfactant, the silane or their combinations were partially or totally replaced by another corresponding compound. The data of content indicate the amount of the solid components except for the alcohols.

TABLE 1

Compositions and pH values of the aqueous anodizing solutions of the examples according to the invention with the content of the above mentioned dissolved constituents in g/L

| | Example No. | | | | | | | | | |
|---|---|---|---|---|---|---|---|---|---|---|
| | 1 | 2 | 3 | 4 | 5 | 6 | 7 | 8 | 9 | 10 |
| $Na_2HPO_4$ | 92.2 | 89.0 | 66.8 | 50.1 | 90.0 | 90.0 | 95.0 | 50.1 | 50.1 | 66.8 |
| KOH | 31.0 | 30.0 | 22.5 | 16.9 | 30.0 | 30.0 | 40.0 | 40.0 | 40.0 | 50.0 |
| amino-methyl propanol | 15.5 | 35.0 | 26.3 | 19.7 | 19.7 | 0 | 0 | 15.5 | 15.5 | 15.5 |
| Brij ® 97 | 0.20 | 0.20 | 0.15 | 0.10 | 0.10 | 0.20 | 0.20 | 0.20 | 0.20 | 0.20 |
| aminopropyl silane | 0 | 0 | 0 | 0 | 0 | 20 | 40 | 40 | 20 | 0 |
| pH | 11.2 | 11.5 | 11.2 | 11.0 | 11.2 | 11.5 | 11.8 | 12.0 | 12.2 | 12.5 |

| | Example No. | | | | | | | | | |
|---|---|---|---|---|---|---|---|---|---|---|
| | 11 | 12 | 13 | 14 | 15 | 16 | 17 | 18 | 19 | 20 |
| Na2HPO4 | 70.5 | 70.5 | 70.5 | 85.0 | 85.0 | 85.0 | 85.0 | 85.0 | 85.0 | 85.0 |
| KOH | 35.0 | 35.0 | 35.0 | 30.0 | 30.0 | 30.0 | 30.0 | 30.0 | 30.0 | 30.0 |
| amino-methyl propanol | 17.0 | 17.0 | 0 | 19.7 | 9.7 | 0 | 19.7 | 0 | 0 | 0 |
| triethanolamine | 0 | 0 | 0 | 0 | 10.0 | 19.7 | 0 | 0 | 0 | 0 |
| Brij ® 97 | 0.20 | 0.20 | 0.20 | 0.10 | 0.10 | 0.10 | 0 | 0.10 | 0.10 | 0.10 |
| non-ionic surfactant | 0 | 0 | 0 | 0 | 0 | 0 | 0.10 | 0 | 0 | 0 |
| aminopropyl silane | 0 | 20 | 20 | 0 | 0 | 0 | 0 | 20 | 10 | 0 |
| ureidopropyl silane | 0 | 0 | 0 | 0 | 0 | 0 | 0 | 0 | 10 | 20 |
| pH | 11.5 | 11.8 | 11.5 | 11.1 | 11.4 | 11.7 | 11.1 | 11.5 | 11.5 | 11.5 |

The anodizing was performed in a laboratory tank with a stainless steel (SS316) electrode as the cathode and with direct current. The compositions of the table generated coatings on magnesium alloys AZ31 and AZ91 as well as on aluminum alloys Al5053 and Al6061 with good or even excellent results depending on the anodizing composition. The magnesium alloys showed significantly better anodizing coatings prepared with these very alkaline anodizing solutions than the aluminum alloys. Parallel hereto, some corresponding compositions similar to the above mentioned compositions but with a pH of 7.5 to 8.5 were tested with the aluminum alloys Al5053 and Al6061. Especially for the magnesium samples, the anodizing coating was of excellent visual quality. The results on the aluminum alloys were better when using a pH in the range from 7.5 to 8.5. It was found that better results of corrosion resistance and visual coating quality are generated with compositions showing a higher content of the at least one phosphorus containing compound.

Comparison Example 21 and Example 22

Corrosion Resistance of the Anodizing Coatings

Comparison Example 21

Two panels of magnesium alloy AZ31 were cleaned in an alkaline cleaning solution. The first panel was coated in a prior art anodizing solution described in MIL-M-45202 Type II for 10 minutes. This solution is based on chromate, phosphoric acid and fluoride.

Example 22

The second panel was coated with the anodizing solution of example 5 according to the present invention for 10 minutes at 25° C. with a current density of between 2 and 4 A/dm2.

Both panels were tested in 5% salt fog in accordance with ASTM B 117: The first sample was heavily corroded already after 110 hours. The second panel showed less than 1% corrosion after 336 hours.

Example 23 and Comparison Example 24

Corrosion Resistance and Paint Adhesion of Anodizing Coating

Example 23

A panel of the magnesium alloy AZ31 was anodized in the anodizing solution of example 1 of the present invention for 5 minutes at 25° C. with a current density of between 2 and 4 A/dm2. The panel was then coated with a standard primer on the base of strontium chromate of 25 μm thickness and afterwards painted with a polyurethane topcoat of 40 μm thickness by spraying according to the standards MIL-PRF-85582D Class C2 and MIL-PRF-85285. Then it was tested in 5% salt fog in accordance with salt spray testing of ASTM B 117 for 1000 hours. The panel showed after one exposition of 1000 h results of U<1 at the scribe.

Comparison Example 24

A panel of the magnesium alloy AZ31 was anodized in the anodizing solution as described in standard MIL M 45202 Type II for 5 minutes at 25° C. with a current density of between 2 and 4 A/dm2. The panel was then coated with a standard primer on the base of strontium chromate of 25 μm thickness and afterwards painted with a polyurethane topcoat of 40 μm thickness by spraying according to the same aircraft standards MIL-PRF-85582D Class C2 and MIL-PRF-85285. Then it was tested in 5% salt fog in accordance with salt spray testing of ASTM B 117 for up to 1000 hours. The panel showed already after 1000 h results of U>5 at the scribe.

The invention claimed is:

1. A method of treating the surface of a metallic workpiece comprising the steps of:

providing a surface comprising at least one of a metal, a metal alloy, or a mixture thereof, whereby at least one of the metal or metal alloy is anodizable and is used as an anode;

contacting said metallic surface with an anodizing solution;

providing at least one other electrode in contact with said anodizing solution; and passing an electric current between said metallic surface and said other electrode through said anodizing solution to form a gel layer on said metallic surface to form a layer containing non-conductive polymer on said metallic surface, wherein the non-conductive polymer is transformed to a gel layer and wherein the gel layer is stabilized with the aid of at least one surfactant, at least one alcohol, or a derivative or mixture thereof, wherein a current density of between 2 and 12 A/dm$^2$ is provided, wherein said anodizing solution is an aqueous solution having a pH greater than 7 and comprises:

a phosphorus and oxygen containing anion in a concentration of from 0.01 to 100 g/L calculated as $PO_4$;

at least one water-soluble inorganic hydroxide;

at least one surfactant;

an alcohol; and at least one alkali metal, wherein said anodizing solution is essentially free of fluorides, and wherein the alcohol is selected from the group consisting of amino-methyl propanol, amino-ethyl propanol, 2-amino-2-methyl-1-propanol and amino-propyl propanol.

2. The method of claim 1, wherein the alcohol is 2-amino-2-methyl-1-propanol.

3. A method of treating the surface of a metallic workpiece comprising the steps of:

providing a surface comprising at least one of a metal, a metal alloy, or a mixture thereof, whereby at least one of the metal or metal alloy is anodizable and is used as an anode;

contacting said metallic surface with an anodizing solution;

providing at least one other electrode in contact with said anodizing solution; and passing an electric current between said metallic surface and said other electrode through said anodizing solution to form a gel layer on said metallic surface to form a layer containing non-conductive polymer on said metallic surface, wherein the non-conductive polymer is transformed to a gel layer and wherein the gel layer is stabilized with the aid of at least one surfactant, at least one alcohol, or a derivative or mixture thereof, wherein a current density of between 2 and 12 A/dm$^2$ is provided, wherein said anodizing solution is an aqueous solution having a pH greater than 7 and comprises:

a phosphorus and oxygen containing anion in a concentration of from 0.01 to 100 g/L calculated as $PO_4$;

a water-soluble inorganic hydroxide;

a surfactant;

an alcohol; and an alkali metal, wherein said anodizing solution is essentially free of fluorides, and wherein the alcohol is selected from the group consisting of amino-methyl propanol, 2-amino-2-methyl-1-propanol and amino-propyl propanol.

4. A method of treating the surface of a metallic workpiece comprising the steps of:

providing a surface comprising at least one of a metal, a metal alloy, or a mixture thereof, whereby at least one of the metal or metal alloy is anodizable and is used as an anode;

contacting said metallic surface with an anodizing solution;

providing at least one other electrode in contact with said anodizing solution; and passing an electric current between said metallic surface and said other electrode through said anodizing solution to form a gel layer on said metallic surface to form a layer containing non-conductive polymer on said metallic surface, wherein the non-conductive polymer is transformed to a gel layer and wherein the gel layer is stabilized with the aid of at least one surfactant, at least one alcohol, or a derivative or mixture thereof, wherein a current density of between 2 and 12 A/dm$^2$ is provided, wherein said anodizing solution is an aqueous solution having a pH greater than 7 and comprises:

a phosphorus and oxygen containing anion in a concentration of from 0.01 to 100 g/L calculated as $PO_4$;

at least one water-soluble inorganic hydroxide;

at least one surfactant;

an alcohol; and at least one alkali metal, wherein said anodizing solution is essentially free of fluorides, and wherein the alcohol is selected from the group consisting of amino-ethyl propanol, 2-amino-2-methyl-1-propanol and amino-propyl propanol.

5. A method of treating the surface of a metallic workpiece comprising the steps of:

providing a surface comprising at least one of a metal, a metal alloy, or a mixture thereof, whereby at least one of the metal or metal alloy is anodizable and is used as an anode;

contacting said metallic surface with an anodizing solution;

providing at least one other electrode in contact with said anodizing solution; and passing an electric current between said metallic surface and said other electrode through said anodizing solution to form a gel layer on said metallic surface to form a layer containing non-conductive polymer on said metallic surface, wherein the non-conductive polymer is transformed to a gel layer and wherein the gel layer is stabilized with the aid of at least one surfactant, at least one alcohol, or a derivative or mixture thereof, wherein a current density of between 2 and 12 A/dm$^2$ is provided, wherein said anodizing solution is an aqueous solution having a pH greater than 7 and comprises:

a phosphorus and oxygen containing anion in a concentration of from 0.01 to 100 g/L calculated as $PO_4$;

a water-soluble inorganic hydroxide;

a surfactant;

an alcohol; and an alkali metal, wherein said anodizing solution is essentially free of fluorides, and wherein the alcohol is amino methyl-propanol.

6. A method of treating the surface of a metallic workpiece comprising the steps of:

providing a surface comprising at least one of a metal, a metal alloy, or a mixture thereof, whereby at least one of the metal or metal alloy is anodizable and is used as an anode;

contacting said metallic surface with an anodizing solution;

providing at least one other electrode in contact with said anodizing solution; and passing a non-pulsed direct electric current between said metallic surface and said other electrode through said anodizing solution to form a gel layer on said metallic surface, wherein said anodizing solution is an aqueous solution having a pH greater than 7 and comprises:

a phosphorus and oxygen containing anion in a concentration of from 0.01 to 100 g/L calculated as $PO_4$;

a water-soluble inorganic hydroxide;

a surfactant;

an alcohol; and an alkali metal, to form a layer containing non-conductive polymer on said metallic surface, wherein the non-conductive polymer is transformed to a gel layer and wherein the gel layer is stabilized with the aid of at least one surfactant, at least one alcohol, or a derivative or mixture thereof, wherein the non-pulsed direct current has a current density of between 2 and 12 A/dm$^2$, and wherein the alcohol is 2-amino-2-methyl-1-propanol.

7. A method of treating the surface of a metallic workpiece having at least on a portion of the metallic surface an anodizable material whereby the method comprises the steps of:

a) providing a surface of at least one metal, or at least one alloy or any combination of them, whereby at least one of the metals and alloys is anodizable that is used as an anode;

b) contacting said metallic surface with an anodizing solution;

c) providing at least one other electrode in contact with said anodizing solution; and d) passing an electric current between said metallic surface and said other electrode through said anodizing solution;

e) providing a layer containing at least one non-conductive polymer on the metallic surface in the earliest stage of the anodizing, f) wherein the non-conductive polymer containing layer on the metallic surface aids the formation of micro-plasma arcs, g) wherein the non-conductive polymer containing layer is transformed to a gel layer in which gel micelles are oriented according to the electromagnetic field, h) wherein micro-plasma arcs are generated during anodizing, i) whereby the micro-plasma arcs are controlled, j) wherein there is essentially no break-down of the coating or wherein there is generation of only very small pores that are typically not visible on the surface of the anodizing coating with the naked eye, k) wherein the gel micelles are kept at a distance from each other, l) wherein there are channels or gaps directed rectangular to the metallic surface between at least some of the micelles, m) wherein these channels or gaps are at least partially prevented to close during the anodizing and n) wherein the anodizing layer is built up during the anodizing by decomposition of the gel layer and by oxidation of parts of the metallic surface;

wherein the anodizing solution has a pH greater than 7 and wherein the anodizing solution comprises:

a phosphorus and oxygen-containing anion in a concentration of from 0.01 to 100 g/L calculated as $PO_4$;

at least one water-insoluble inorganic hydroxide;

at least one surfactant;

an alcohol; and at least one alkali metal, wherein the alcohol is selected from the group consisting of amino-methyl propanol, amino-ethyl propanol, 2-amino-2-methyl-1-propanol and amino-propyl propanol.

8. A method of treating the surface of a metallic workpiece having at least on a portion of the metallic surface an anodizable material whereby the method comprises the steps of:

a) providing a surface of at least one metal, or at least one alloy or any combination of them, whereby at least one of the metals and alloys is anodizable that is used as an anode;

b) contacting said metallic surface with an anodizing solution;

c) providing at least one other electrode in contact with said anodizing solution; and d) passing an electric current between said metallic surface and said other electrode through said anodizing solution;

e) providing a layer containing at least one non-conductive polymer on the metallic surface in the earliest stage of the anodizing, f) wherein the non-conductive polymer containing layer on the metallic surface aids the formation of micro-plasma arcs, g) wherein the non-conductive polymer containing layer is transformed to a gel layer in which gel micelles are oriented according to the electromagnetic field, h) wherein micro-plasma arcs are generated during anodizing, i) whereby the micro-plasma arcs are controlled, j) wherein there is essentially no break-down of the coating or wherein there is generation of only very small pores that are typically not visible on the surface of the anodizing coating with the naked eye, k) wherein the gel micelles are kept at a distance from each other, l) wherein there are channels or gaps directed rectangular to the metallic surface between at least some of the micelles, m) wherein these channels or gaps are at least partially prevented to close during the anodizing and n) wherein the anodizing layer is built up during the anodizing by decomposition of the gel layer and by oxidation of parts of the metallic surface;

wherein the anodizing solution has a pH greater than 7 and wherein the anodizing solution comprises:

a phosphorus and oxygen-containing anion in a concentration of from 0.01 to 100 g/L calculated as $PO_4$;

a water-insoluble inorganic hydroxide;

a surfactant;

amino methyl-propanol, and at least one alkali metal.

9. A method of treating the surface of a metallic workpiece having at least on a portion of the metallic surface an anodizable material whereby the method comprises the steps of:

a) providing a surface of at least one metal, or at least one alloy or any combination of them, whereby at least one of the metals and alloys is anodizable that is used as an anode;

b) contacting said metallic surface with an anodizing solution;

c) providing at least one other electrode in contact with said anodizing solution; and d) passing an electric current between said metallic surface and said other electrode through said anodizing solution;

e) providing a layer containing at least one non-conductive polymer on the metallic surface in the earliest stage of the anodizing, f) wherein the non-conductive polymer containing layer on the metallic surface aids the formation of micro-plasma arcs, g) wherein the non-conductive polymer containing layer is transformed to a gel layer in which gel micelles are oriented according to the electromagnetic field, h) wherein micro-plasma arcs are generated during anodizing, i) whereby the micro-plasma arcs are controlled, j) wherein there is essentially no break-down of the coating or wherein there is generation of only very small pores that are typically not visible on the surface of the anodizing coating with the naked eye, k) wherein the gel micelles are kept at a distance from each other, l) wherein there are channels or gaps directed rectangular to the metallic surface between at least some of the micelles, m) wherein these channels or gaps are at least partially prevented to close during the anodizing and n) wherein the anodizing layer is built up during the anodizing by decomposition of the gel layer and by oxidation of parts of the metallic surface;

wherein the anodizing solution has a pH greater than 7 and wherein the anodizing solution comprises:

a phosphorus and oxygen-containing anion in a concentration of from 0.01 to 100 g/L calculated as $PO_4$;

a water-insoluble inorganic hydroxide;

a surfactant;

an alcohol, and at least one alkali metal, wherein the alcohol is 2-amino-2-methyl-1 propanol.

* * * * *